US005274302A

United States Patent [19]

Capek et al.

[11] Patent Number: 5,274,302

[45] Date of Patent: Dec. 28, 1993

[54] STRESS TRANSPARENT TENSION MASK FRAME MEMBER FOR REDUCING SLURRY PARTICLE AGGLUTINATION

[75] Inventors: Raymond G. Capek, Elmhurst; Siegfried M. Greiner, Crystal Lake, both of Ill.

[73] Assignee: Zenith Electronics Corporation, Glenview, Ill.

[21] Appl. No.: 779,684

[22] Filed: Oct. 21, 1991

[51] Int. Cl.[5] ..... H01J 29/07

[52] U.S. Cl. ..... 313/407; 313/408; 313/482; 445/30

[58] Field of Search ..... 313/402, 407, 468, 482; 445/37, 47, 30

[56] References Cited

U.S. PATENT DOCUMENTS 4,362,963 12/1982 Puhak et al. ..... 313/407
4,737,681 4/1988 Dietch et al. ..... 313/402
4,745,330 5/1988 Capek et al. ..... 313/407
4,778,427 10/1988 Strauss .
4,804,881 2/1989 Strauss .
4,891,545 1/1990 Capek et al. ..... 313/407
4,891,546 1/1990 Dougherty et al. .
5,053,674 10/1991 Gismondo et al. .
5,103,132 4/1992 Van Der Bolt et al. ..... 313/407

FOREIGN PATENT DOCUMENTS 3521031 12/1986 Fed. Rep. of Germany ..... 313/407
0265425 10/1989 Japan ..... 445/37

*Primary Examiner*—Donald J. Yusko
*Assistant Examiner*—N. D. Patel

[57] ABSTRACT

A covering for a discontinuity in a mask support frame for a tension mask cathode ray tube comprises a stiff yet flexible (or bendable) metal strip having a first surface for facing a mask frame surface which is proximal to a phosphor screen, and attachment to the mask frame on at least one side of the discontinuity, and a second surface facing the phosphor screen. A portion of the covering may be formed to match the cross-section profile of the mask frame surface to which it is attached. The covering may be formed in a continuous rectangle to form a rectangular frame assembly capable of attachment to a faceplate.

18 Claims, 4 Drawing Sheets

STRESS TRANSPARENT TENSION MASK FRAME MEMBER FOR REDUCING SLURRY PARTICLE AGGLUTINATION

CROSS-REFERENCE TO RELATED APPLICATIONS AND PATENTS

This application is related to but in no way dependent upon copending application Ser. No. 427,149, now U.S. Pat. No. 5,162,694 filed Oct. 24, 1989, of common ownership herewith.

BACKGROUND OF THE INVENTION

Field of the Invention

This invention relates to color cathode ray picture tubes used in television sets and computer monitors. It is addressed specifically to means and methods for facilitating the manufacture of tubes that utilize the tension foil shadow mask.

The image that appears on the faceplate of a tension mask color cathode ray tube results from the excitation of phosphors deposited on the inner surface of the faceplate by three electron beams emitted by an electron gun in the neck of the tube. Three different phosphors are deposited on the inner surface that emit red, green and blue light when excited. Selective excitation of the respective phosphors is accomplished by the imposition of a tensed, perforated foil known as the "shadow mask" between the source of the three beams and the phosphor screen. The shadow mask acts as a parallax barrier which ensures that a respective beam will excite only the intended phosphor targets.

The phosphors are deposited on the screen area of the inner surface of the faceplate in a predetermined pattern which consist of triads of red, green and blue dots of phosphor to form what is termed a dot screen.

The dots of phosphor that make up each triad are enclosed by a dark material known as the black surround. In the screen manufacturing process, the black surround is deposited first, forming a black pattern on the inner surface of the faceplate having round, transparent apertures for receiving respective ones of the three color phosphors. The green-light-emitting phosphor is then deposited, forming a green dot in the aperture in each triad allotted to receive a green phosphor dot. The phosphors that emit blue and red light are next deposited in sequence in their allotted spaces in each triad.

The apertures in the tensed foil shadow mask are used to photolithographically form the screen, using light sources that simulate the location of each of the three beams emitted by the electron gun.

The process of depositing a screen is a process of great precision in view of the fact that, in a 14-inch (diagonal measure) high-resolution tension mask tube, there are about 2.5 million phosphor dots, formed by 830,000 apertures in the shadow mask.

The materials of the black surround and the three phosphors are typically applied to the screening surface of the tube in the form of screening fluids known as as slurries. The slurries comprise suspensions of phosphor particles in an actinic medium that will dry by evaporation, such as polyvinyl alcohol. The slurries are applied to the screening area by spin application; that is, the slurry is poured onto the screening area of the faceplate as the faceplate is rotated. The faceplate is then inverted, and the excess slurry poured off.

In the process of screening, it is imperative that no remnant of slurry be left in the vicinity of the faceplate. Particles can flake off and occlude one or more of the apertures of the closely adjacent shadow mask, resulting in rejection of the finished tube. Also, particles can become electrically charged and circulate within the tube envelope, causing electrical shorts. Remnants of slurry are especially prone to accumulate beneath the tensed foil shadow mask attachment caps that may overhang the ceramic structures of mask support structures, such as the structures shown and described in U.S. Pat. No. 4,891,546 of common ownership herewith.

In commonly owned U.S. Pat. No. 5,053,674, there is disclosed a generally rectangular mounting structure for attaching a tensioned foil shadow mask to a flat glass faceplate of a color cathode ray tube. The structure comprises four rails attached at respective ends thereof by means of four corner brackets spot-welded to adjacent ends of a pair of rails. Each of the four corners is coated with a solder-glass-based sealant to hermetically seal the corner bracket-rail interface. The solder glass is devitrified by baking. The resultant seal prevents phosphor particles from collecting in the gaps between the corner brackets and the coupled rails.

In U.S. Pat. No. 4,804,881 to Strauss, also of common ownership herewith, a tension mask support structure is disclosed in which the structure is sealed to prevent any outgassing from the interior of the structure during the life of the tube. The hollow mask support elements are joined at the corners by connectors which have necked-down portions that plug into the elements. The corner connectors are then welded and brazed to the elements to completely seal off the structure.

OBJECTS OF THE INVENTION

It is a general object of the invention to provide apparatus and a method to facilitate the manufacture of tension mask color cathode ray tubes.

It is another object of the invention to provide savings in labor and cost in the manufacture of tension mask color cathode ray tubes.

It is a further object of the invention to provide apparatus and method that will confine slurries to the screening area of the faceplate.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
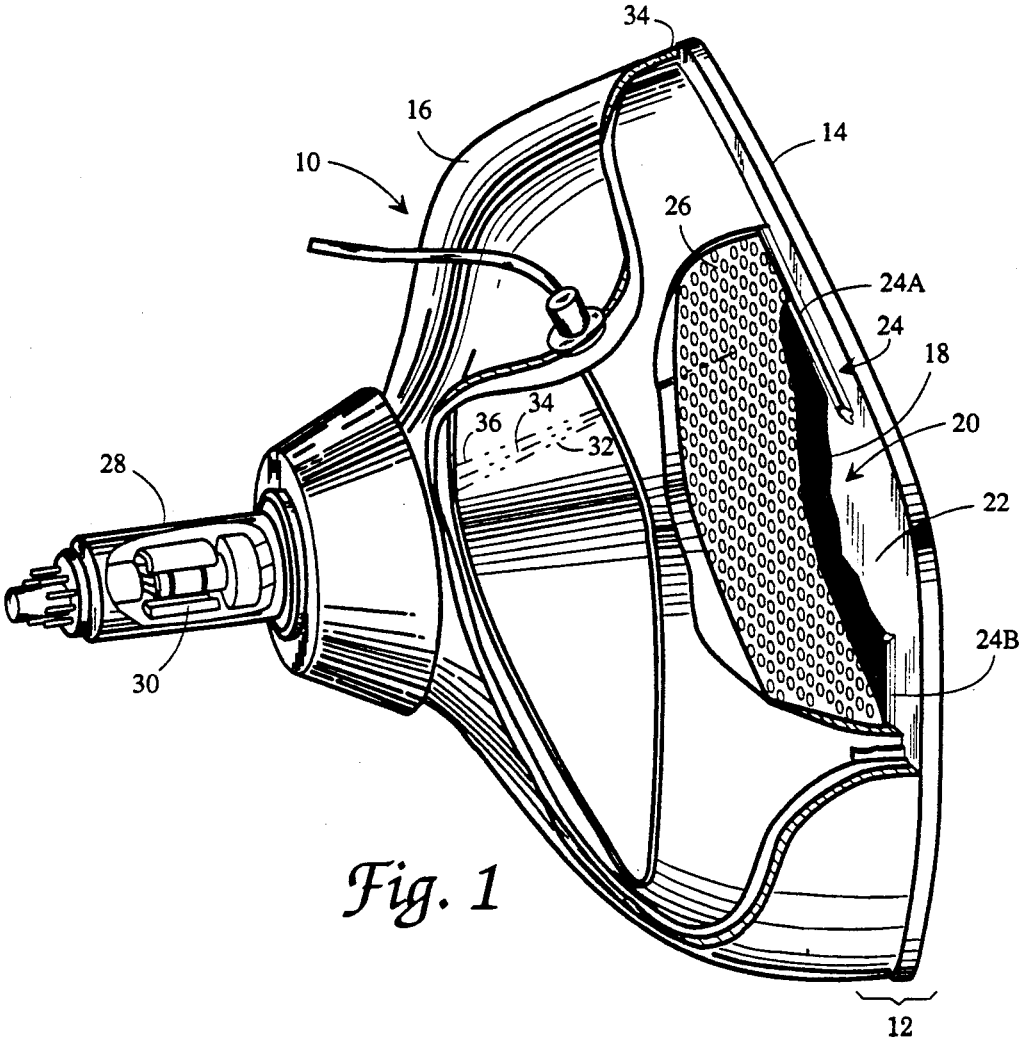
FIG. 1 is a side view in perspective of a tension mask color cathode ray tube that is the subject of this invention, with cutaway sections that indicate the location and relationship of the major components of the tube.
Figure 2:
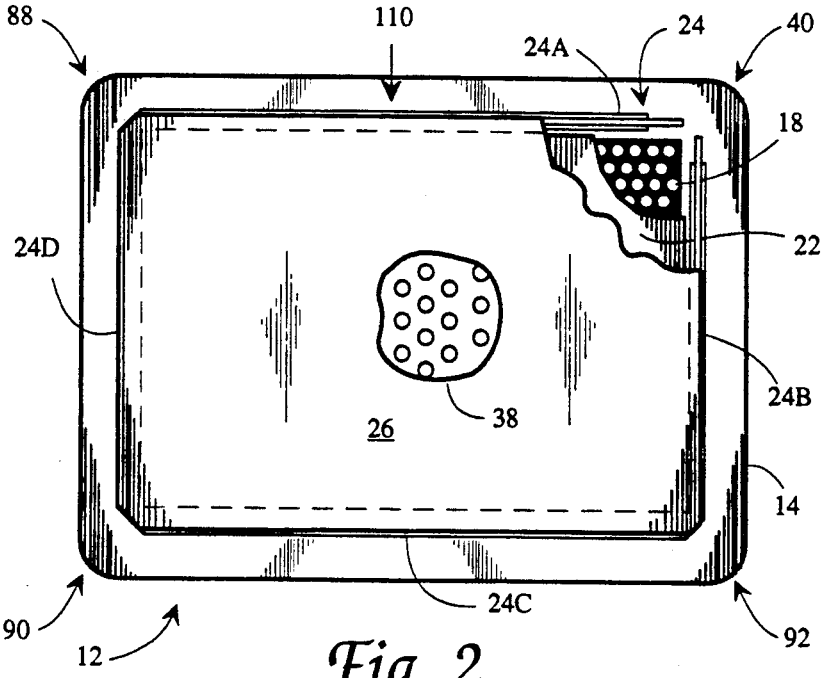
FIG. 2 is a plan view of the front assembly of the tube depicted in FIG. 1, with parts cut away to show the relationship of the faceplate with the mask support structure and shadow mask; insets show mask apertures and phosphor screen patterns greatly enlarged.

With reference to FIGS. 1 and 2, a tension mask color cathode ray tube 10 has a front assembly 12 that includes a faceplate 14 sealed to a funnel 16. A centrally disposed rectangular screen 18 is deposited on the inner surface 20 of faceplate 14. A film of aluminum 22 covers the screen 18. The rectangular screen 18 is enclosed by a mask support frame 24 that extends from the faceplate 14 for receiving and attaching a metal foil shadow mask 26 in tension. In the embodiment shown, Mask support frame 24 consists of four non-continuous rails; that is, rails unjoined at the corners, and designated respectively by reference numbers 24A, 24B, 24C and 24D. The neck 28 that extends from funnel 16 encloses an in-line electron gun 30 that projects three discrete electron beams 32, 34 and 36 that excite the phosphors deposited on screen 18 that emit red, green and blue light.

FIG. 2 depicts front assembly 12 in greater detail. The triad of dots that make up screen 18 are indicated greatly enlarged, as are the apertures of the shadow mask 26 indicated in inset 38.

Figure 3:
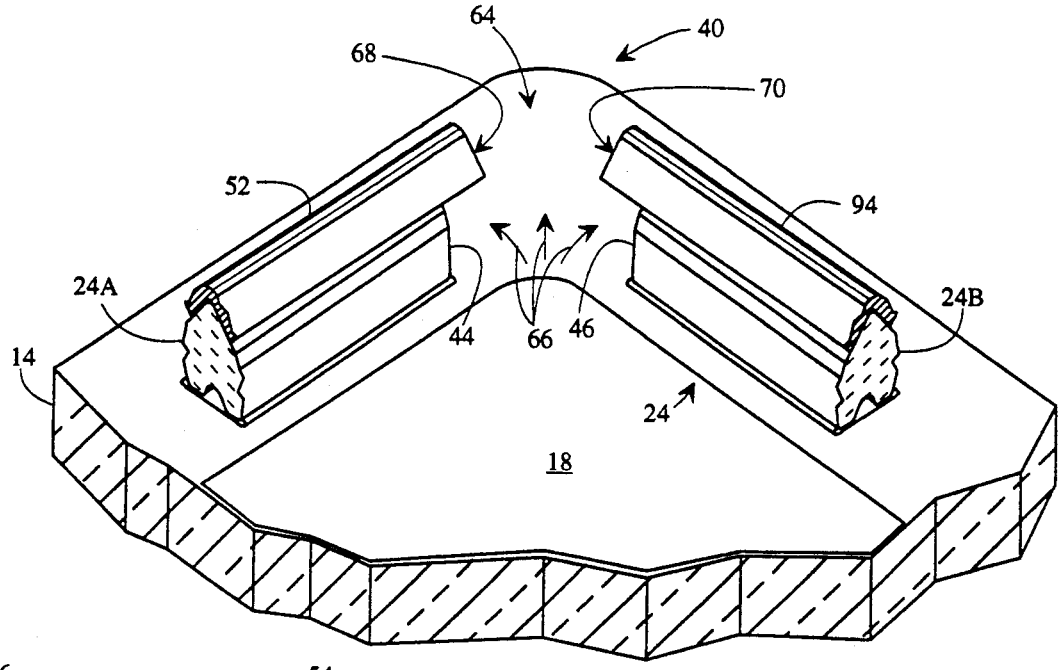
FIG. 3 is a view in perspective of a corner section of a faceplate depicting a mask support structure with a discontinuity at a corner of the structure.

FIG. 3 depicts a section of the corner 40 of FIG. 2, showing the intersection of the ends 44 and 46 respectively of rails 24A and 24B of mask support frame 24. The profile of the rail 24A, which is identical to the profile of rails 24B, 24C and 24D, is indicated by a cross-sectional view in FIG. 4. The structure 48 of rail 24A, indicated symbolically as being a ceramic, has in cross-section the aspect of a house with a saddle roof 50 with sloping sides, to which is attached a conforming metal cap 52. Shadow mask 26 is welded to a mask attachment surface 54 machine-ground to a flat at the peak of metal cap 52. The base 56 of the rail is cemented to the inner surface 20 of faceplate 14 by devitrifying solder glass 58, indicated by the dot pattern. The excess solder glass that flows from under base 56 appears upon devitrification of the solder glass in the form of beads 60 and 62. The metal cap 52 is cemented to the slope of saddle roof 50, also by devitrifying solder glass.

It will be noted that the base 56 of rail 24A does not make actual contact with inner surface 20 of faceplate 14, but is preferably spaced a predetermined distance from the inner surface. The intervening layer 57 of devitrifying solder glass, in conjunction with the solder glass in groove 59, is helpful in providing the proper correlation of the coefficients of thermal contraction of the ceramic structure 48 of rail 24A and the glass of faceplate 14.

The structure and function of the rails represented by rail 24A is fully described and claimed in U.S. Pat. No. 4,891,546 and in referent copending application Ser. No. 427,149 filed Oct. 24, 1989, now U.S. Pat. No. 5,162,694, both commonly owned.

During the formation of screen 18 by the slurry-deposition process, in which slurry is deposited on the faceplate 14 while it is being rotated, excess slurry is impelled through the discontinuity 64 formed at the near-intersection of rails 24A and 24B, a slurry flow indicated by the arrows 66. It is manufacturing practice to invert the faceplate 14 to pour off the excess slurry. In consequence, slurry deposits become agglutinated under the respective overhanging sections 68 and 70 of caps 52 and 94. As has been noted, slurry particles which flake off can result in electrical shorts and occlusion of the apertures of the nearby shadow mask.

Figure 5:
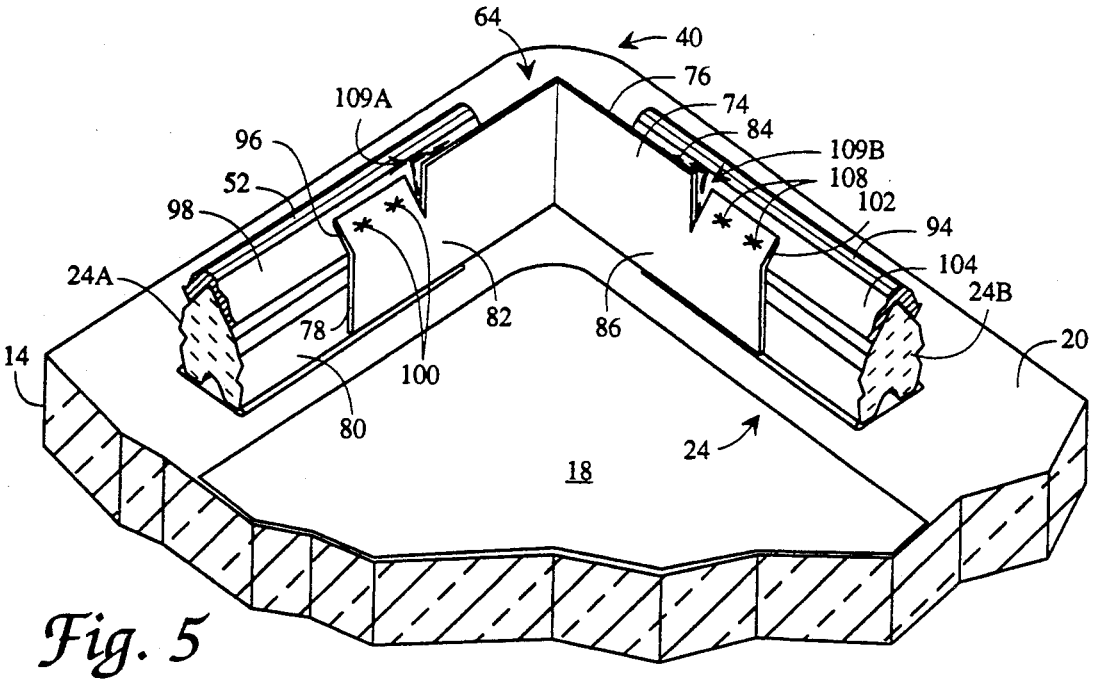
FIG. 5 is a view similar to FIG. 3 showing a covering according to the invention for covering the corner discontinuity depicted in FIG. 3.

In FIG. 5, there is depicted a covering 74 according to the invention for a discontinuity 64 in the tension mask support frame 24. The covering 74 comprises a stiff yet flexible (or bendable) metal strip 76 having a first surface 78 for facing mask frame surface 80 proximal to phospor screen 18, and attachment to the mask frame 24 on at least one side of the discontinuity 64. Covering 74 also includes a second surface 82 facing screen 18.

Covering 74 further comprises a third surface 84 contiguous with, and substantially perpendicular to the first surface 78; and, a fourth surface 86 contiguous with, and substantially perpendicular to the second surface 82. Covering 74 effectively covers the discontinuity 64 in mask support frame 24 between the substantially perpendicular mask support rails 24A and 24B. The same type of covering is also used to cover the discontinuities (not shown) between rails 24A and 24D, rails 24C and 24D, and rails 24B and 24C, that terminate in respective corners 88, 90 and 92 of faceplate 14, all as indicated in FIG. 2.

At least a portion of covering 74 is formed to match a crosssection profile of the mask frame surface to which it is attached. By this means, covering 74 is attached to the metal caps 52 and 94 of respective rails 24A and 24B by welding. Second surface 82 of covering 74 is angled as indicated to provide a bend 96 which contacts side 98 of cap 52. Bend 96 is welded to side 98 preferably by spot welding, as indicated by weld symbols (*) 100. Similarly, third surface 86 of covering 74 is angled to provide a bend 102 which contacts side 104 of cap 94 of rail 24B. Bend 102 is welded to side 104, as indicated by weld symbols (*) 108.

The metal of strip 76 preferably comprises Carpenter alloy No. 27, in a thickness of about 0.012 inch, formed as indicated. Alloy No. 27 is a stainless steel alloy compatible with the internal environment of a cathode ray tube. It is manufactured by Carpenter Technology of Reading, Penn.

Another benefit of the invention lies in the fact that, in addition to covering the discontinuity between the ends of the rails, the mask frame is made up of the four rails linked together with the coverings as described. This linkage forms a "unitized" mask support assembly that can be handled as one piece, a unit of manufacture which can be positioned more readily and precisely on the inner surface of the faceplate.

A discontinuity in mask support rails that is formed in other than the corners of the frame can also be covered by the inventive means. Such a discontinuity may be formed at the midpoint of a rail; such a midpoint 110 of rail 24A, the location of which is indicated in FIG. 2. One or more of such discontinuities in the rails of a mask support frame forms what is termed "the segmented rail." The segmented rail and its application to the tension mask color cathode ray tube is fully described and claimed in referent copending application Ser. No. 427,149, of common ownership herewith, now U.S. Pat. No. 5,162,694. A segmented mask support frame is defined as one in which the rails that make up the frame are formed of discrete mask support structures with discontinuities therebetween. The number of such mask support structures in a segmented rail may vary from two to as many as eight.

Figure 6:
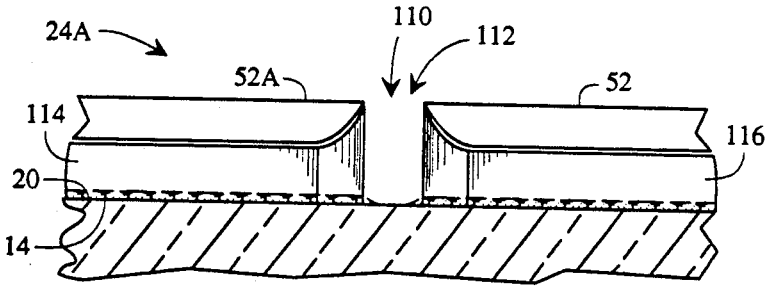
FIG. 6 is a view of the mid-section of a mask support rail having a discontinuity between mask-support structures.

The configuration of the rail 24A at midpoint 110 is depicted in FIG. 6, showing the discontinuity 112 in rail 24A that lies between two of the mask support structures 114 and 116 of rail 24A. In this case, rail 24A consists of two mask support structures.

Figure 4:
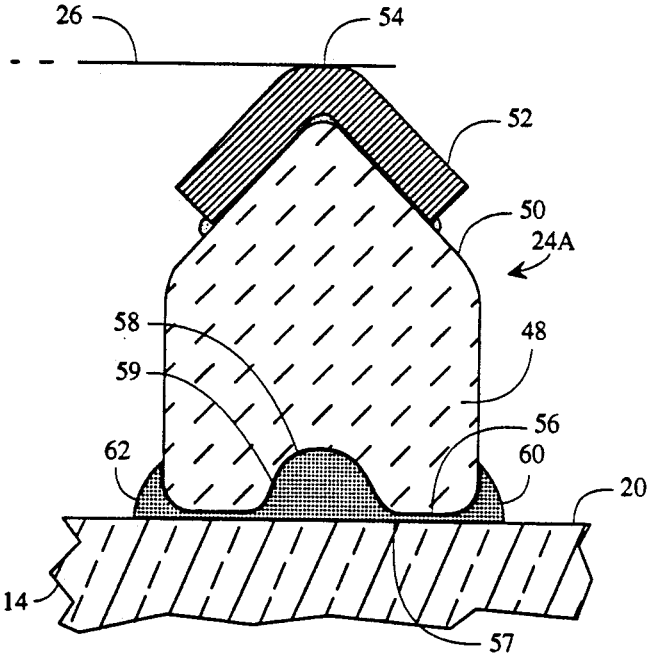
FIG. 4 is a cross-sectional profile view of the mask support structure shown by FIG. 3.
Figure 7:
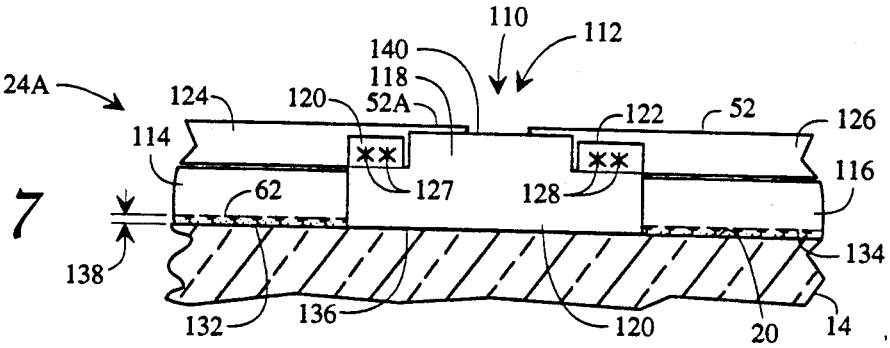
FIG. 7 is a view similar to FIG. 6 showing a covering according to the invention for a discontinuity.

FIG. 7 depicts a covering 118 at midpoint 110 of rail 24A for covering discontinuity 112. Like covering 74 depicted in FIG. 5, covering 118 is formed of a metal strip that is stiff yet flexible (or bendable); however, covering 118 is in the form of a continuous rectangle and does not have the right angle configuration of covering 74 shown by FIG. 5. Sections 120 and 122 of cover 118 are bent as indicated to contact the respective sides 124 and 126 of the metal caps 52A and 52 of structures 114 and and 116. Covering 118 is attached to structures 114 and 116 by welding sections 120 and 122 to the metal caps 52A and 52, respectively, preferably by spot welding, as indicated by weld symbols (*) 127 and 128. The respective structures 114 and 116 of rail 24A are attached to the inner surface 20 of faceplate 14 by a bead 62 of devitrifying solder glass. (The bead 60 on the opposite side of the rail is shown by FIG. 4.) With reference to FIG. 5, to increase the efficacy of the covering 74, the tabs 109A and 109 B formed in covering 74 by respective bends 96 and 102, may be bent inwardly into contact with sides 98 and 104 of caps 52 and 94, a configuration indicated by the associated dash lines. The ends of the tabs may then be "tacked" by spot welds to the metal of caps 52 and 94.

Figure 7A:
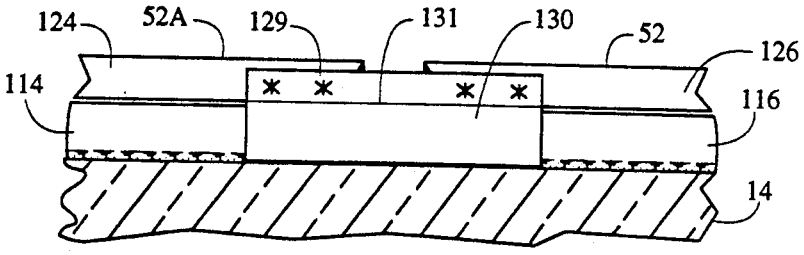
FIG. 7A is a view similar to FIG. 7 showing another embodiment of a covering for a discontinuity.

The covering of the discontinuity according to a invention may as well comprise the configuration depicted in FIG. 7A. In this embodiment, rather than just a portion of the covering being formed to match the cross-sectional profile of the mask frame surface to which it is attached, the entire top portion 129 of covering 130 is bent at bend line 131 to contact the respective sides 124 and 126 of caps 52A and 52.

With reference again to FIG. 7, the bottom 136 of the strip of metal comprising covering 118 will be noted as extending below respective bases 132 and 134, indicated by the dash lines, of mask support structures 114 and 116, and into contact with inner surface 20 of the faceplate 14. This extension acts as a gage to space base 132 and base 134 of mask support structures 114 and 116 a predetermined distance from the inner surface 20 of faceplate 14. The need for such spacing is described in the foregoing in connection with FIG. 4.

Figure 4A:
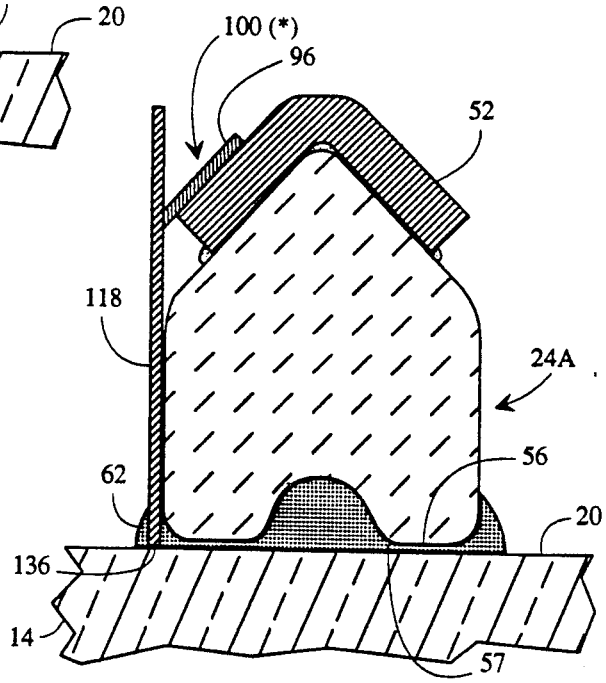
FIG. 4A is a view similar to FIG. 4 depicting a covering according to the invention as seen in a cross-sectional profile view.

The extension of the bottom 136 of covering 118 into contact with the inner surface 20 of the faceplate 14 is depicted in FIG. 4A. The bottom 136 of covering 118 is shown as penetrating the bead 62 of devitrifying solder glass. The amount of spacing is indicated symbolically by reference number 138 shown in FIG. 7; by way of example, the spacing may be in the range of a few thousandths of an inch to as much as 0.010 inch, depending upon the size of the rail and the tube in which it is used.

The top 140 of the strip of metal comprising covering 118 may as well extend above the tops of caps 52A and 52, and the mask-receiving surface of the caps. The excess material of this extension will not interfere with the installation of the tensed foil shadow mask as it will be removed during the process in which the top surface of the caps is ground to a flat for receiving and attaching a foil shadow mask in tension. The procedure for grinding metal rails or metal-capped ceramic rails is fully described and claimed in U.S. Pat. No. 4,908,995 of common ownership herewith.

It is to be noted that the apparatus described in connection with FIGS. 3–7 has relevance to the following description of the apparatus shown by FIGS. 8 and 9, and all details are not repeated for the sake of brevity.

Figure 8:
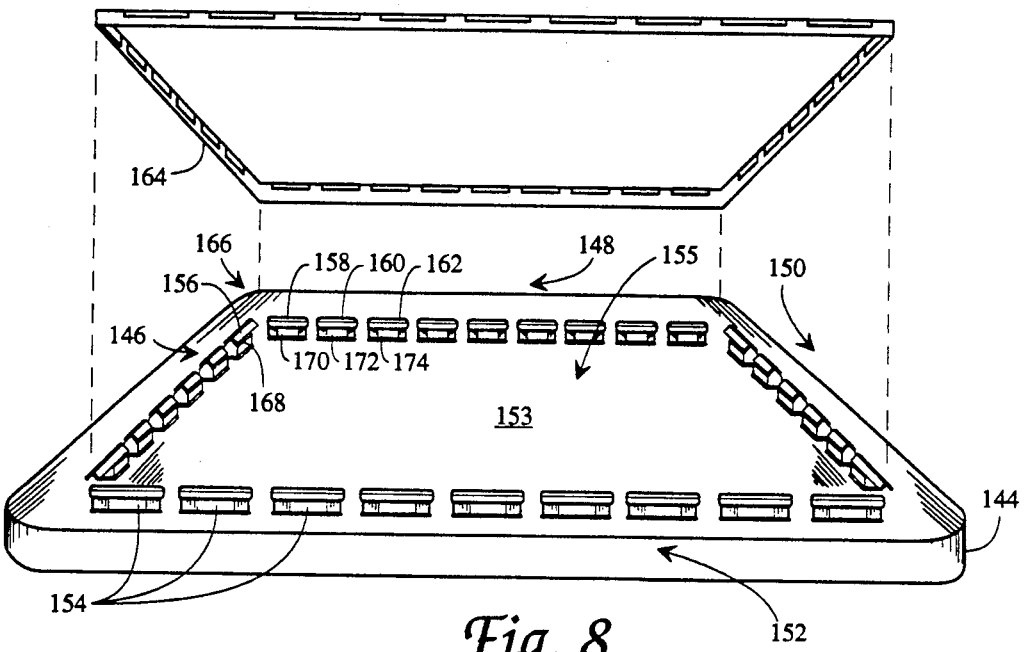
FIG. 8 is a perspective view of a faceplate having a mask support frame made up of discrete mask support structures having discontinuities therebetween; a rectangular metal strip intended for covering the discontinuities is shown as exploded from the faceplate; and, FIG. 9 is a perspective view of a detail of a corner section of the faceplate shown by FIG. 8, with the metal strip covering the gaps between the discrete mask support structures.

FIG. 8 depicts a faceplate 144 having four rails 146, 148, 150 and 152 installed thereon and having a rectangular phosphor screen 153 disposed on its inner surface 155. The rails are made up of a plurality of discrete mask-support structures, typified by mask support structures 154 that are a part of rail 152. The mask support structures of rails 146, 148, 150 and 152 are surmounted by metal caps typified by caps 156, 158, 160 and 162 for receiving and attaching a foil shadow mask in tension (not indicated). Caps 156, 158, 160 and 162, shown as being discontinuous and covering the mask support structures to which they are attached, may as well comprise a continuous cap forming a complete rectangular frame for attachment of a tension mask.

A rectangular metal strip 164 is shown as exploded from faceplate 144. When attached to the respective rails 146, 148, 150 and 152 on rail surfaces proximal to the phosphor screen 153, strip 164 covers the discontinuities between the discrete mask support structures.

Figure 9:
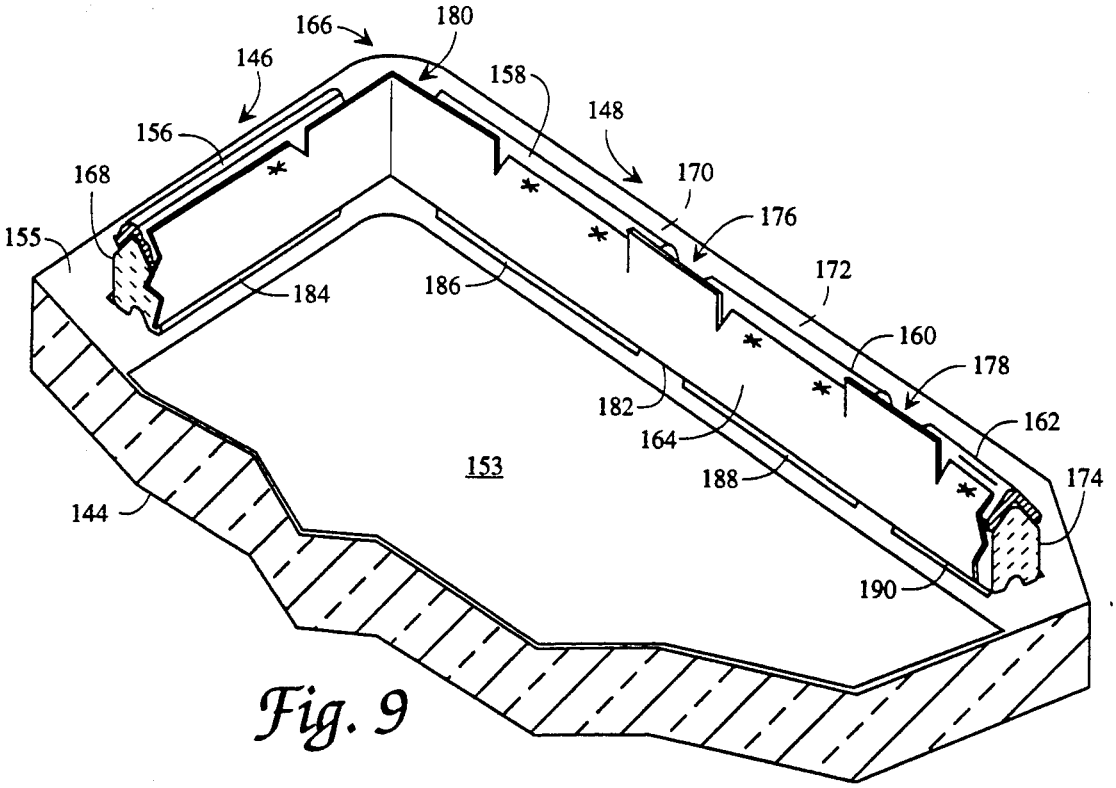

With additional reference to FIG. 9, there is shown a detail view of a section of faceplate 144, depicting a corner 166 of faceplate 144, and showing a section consisting of rail 146 with one mask support structure 168 depicted, and rail 148 with a depiction of three mask support structures 170, 172 and 174. Strip 164, installed proximal to phosphor screen 153, covers the respective discontinuities 176 and 178 in rail 148, and discontinuity 180 in corner 166 that lies between rails 146 and 148. Strip 164 is of sufficient thickness to be stiff yet flexible (or bendable), and is shown as being connected directly to the angled portions of mask support structures 168, 170, 172 and 174 by welding, indicated by the weld symbols (*) to the respective metal caps. As has been noted, the strip preferably comprises Carpenter No. 27 stainless steel alloy having a thickness of 0.012 inch. As has been described in detail in connection with FIGS. 5 and 7, a portion of strip 164 is formed to match a cross-section profile of the mask frame surface to which it is attached. This matching is accomplished by angling the sections marked by the weld symbols to provide bends which contact the sides of the respective caps 156, 158, 160 and 162.

With the exception of the covering for the discontinuity 180 in the corner 166 of faceplate 144, rather than forming a portion of the strip that comprises covering 164 to match the cross-sectional profile of the mask frame surface to which the strip is attached, the entire top portion of the strip may be bent to contact the respective sides of the caps. This embodiment of a covering is depicted in FIG. 7A, in which the top portion 129 of covering 130 is bent at bend line 131 to contact the respectives sides of the caps 52A and 52.

The bottom 182 of strip 164 extends below the respective bases of mask support structures 168–174, and into the respective beads of devitrifying solder glass 184, 186, 188 and 190 of the mask support structures 168–174. As noted in connection with FIG. 7 and its description, the extension acts as a gage to space the mask support structures a predetermined distance from the inner surface 155 of faceplate 144.

By forming the strip 164 to fit snugly within the frame formed by rails 146–152 (shown by FIG. 8), and connecting strip 164 to the mask support structures on at least one side of the discontinuities between the structures, a rectangular frame assembly is formed capable of attachment to faceplate 144.

It is to be noted that neither strip 164 shown by FIG. 9, nor the covering 74 shown by FIG. 5, nor the covering 118 shown by FIG. 7, will by their presence, add to the stresses induced into the glass of the respective faceplates by the rails. The stress-inducing effect of attaching the rails of a mask support frame to a faceplate is fully described in referent copending application Ser. No. 427,149, now U.S. Pat. No. 5,162,694, of common ownership herewith.

While a particular embodiment of the invention has been shown and described, it will be readily apparent to those skilled in the art that changes and modifications may be made in the inventive means without departing from the invention in its broader aspects, and therefore, the aim of the appended claims is to cover all such changes and modifications as fall within the true spirit and scope of the invention.

We claim:

1. A front assembly for a tension mask color cathode ray tube comprising:

a) a faceplate;

b) a mask frame for supporting the shadow mask, the mask frame having a discontinuity;

c) a phosphor screen on the faceplate surrounded by the mask frame;

d) a covering for the discontinuity comprising a stiff yet bendable metal strip;

e) the strip having:

1) a first surface for facing an exterior mask frame surface proximal to a phosphor screen, and attachment to the mask frame on at least on side of the discontinuity;

2) a second surface for facing the phosphor screen.

2. The front assembly according to claim 1 in which the covering further comprises:

a) a third surface contiguous with, and substantially perpendicular to the first surface;

b) a fourth surface contiguous with, and substantially perpendicular to the second surface;

whereby the covering may cover a discontinuity between substantially perpendicular mask support structures.

3. The front assembly according to claim 1 wherein a first portion of the strip is formed to match a cross-sectional profile of the mask frame surface to which it is to be attached.

4. The front assembly according to claim 1 wherein the covering is formed in a continuous rectangle sized to fit snugly within the mask frame.

5. The front assembly according to claim 3 wherein a second portion of the strip is not formed to match the cross-sectional profile of the mask frame surface to which it is attached.

6. A tension mask color cathode ray tube comprising:

a) a faceplate having a rectangular phosphor screen centrally disposed on its inner surface;

b) a rail secured to the faceplate inner surface along one side of the phosphor screen, the rail comprising a plurality of discrete mask support structures having discontinuities therebetween; and c) a metal strip attached to the rail on an exterior rail surface proximal to the phosphor screen and covering the discontinuities between the discrete mask support structures.

7. The tension mask color cathode ray tube according to claim 6 wherein the mask support structures are connected by a continuous cap for attachment of the tension mask.

8. A tensioned shadow mask support frame assembly comprising:

a) a frame formed of discontinuous mask support structures with discontinuities therebetween, the frame being formed from closed-end rails; and b) a metal strip of sufficient thickness to be stiff yet beadable, the strip connected directly or indirectly to the mask support structures on an exterior surface of the rail proximal to the phosphor screen so as to cover the discontinuities therebetween, thereby forming a unitized, rectangular frame assembly capable of attachment to a faceplate.

9. The shadow mask frame assembly according to claim 8 wherein the strip does not extend above the mask attachment surface of the rail when the strip is connected thereto.

10. The shadow mask frame assembly according to claim 8 wherein the strip extends below the base of the rail when the strip is connected thereto.

11. A method for covering a discontinuity in a tension mask frame for a cathode ray tube, comprising:

a) providing a stiff yet beadable metal strip;

b) forming the strip to have:

1) a first surface for facing an exterior mask frame surface which is proximal to a phosphor screen, and for attachment to the mask frame on at least one side of the discontinuity; and 2) a second surface for facing a phosphor screen.

12. The method according to claim 11 wherein the metal strip is further formed to include:

a) a third surface contiguous with and substantially perpendicular to the first surface; and, b) a fourth surface contiguous with, and substantially perpendicular to the second surface; and, c) covering the discontinuity with the strip and attaching the strip to the frame;

whereby the covering covers a discontinuity between substantially perpendicular mask support structures.

13. The method according to claim 11 including forming at least a portion of the metal strip to match the cross-sectional profile of the mask frame surface to which it is to be attached.

14. The method according to claim 13 including forming the metal strip in a continuous rectangle, and sizing the strip to form a continuous rectangle fitting snugly within the mask frame.

15. The method according to claim 11 including forming a portion of the frame not to match the cross-section profile of the mask frame surface to which it is to be attached.

16. A method for forming a unitized tension mask support frame comprising four discrete rails composed of a series of mask support structures with discontinuities therebetween attached to the inner surface of a faceplate having a centrally disposed phosphor screen, the method comprising:

a) providing a metal strip of sufficient thickness to be stiff yet bendable; and b) covering the discontinuities by connecting the strip directly or indirectly to the mask support structures on a phosphor screen side of the rails, thereby forming a rectangular frame assembly capable of attachment to a faceplate.

17. The method of claim 16 including forming the strip not to extend above the mask attachment surface of the rail when the strip is connected thereto.

18. The method of claim 16 including extending the strip below the base of the rail when attached thereto.

* * * * *